US005449288A

United States Patent [19]

Bass

[11] Patent Number: 5,449,288

[45] Date of Patent: Sep. 12, 1995

[54] ASPIRATED WICK ATOMIZER NOZZLE

[75] Inventor: John C. Bass, La Jolla, Calif.

[73] Assignee: Hi-Z Technology, Inc., San Diego, Calif.

[21] Appl. No.: 217,975

[22] Filed: Mar. 25, 1994

[51] Int. Cl.[6] ..... F23D 3/40; B05B 7/04

[52] U.S. Cl. ..... 431/330; 431/261; 431/326; 239/426; 239/434; 239/DIG. 23

[58] Field of Search ..... 431/261, 330, 327, 326, 431/331, 354, 300, 252, 298; 239/DIG. 23, 426, 434, 418, 419; 60/743

[56] References Cited

U.S. PATENT DOCUMENTS

| | | | |
|---|---|---|---|
| 1,552,677 | 9/1925 | Clawson | 431/330 X |
| 2,087,676 | 7/1937 | Schimmel | 431/327 |
| 2,193,828 | 3/1940 | Mason | 431/330 |
| 2,551,114 | 5/1951 | Goddard . | |
| 2,918,118 | 12/1959 | Schirmer | 60/743 X |
| 3,583,635 | 6/1971 | Lemelson | 239/434 |
| 3,759,658 | 9/1973 | Mifune et al. | 431/300 X |

FOREIGN PATENT DOCUMENTS

| | | | |
|---|---|---|---|
| 0124335 | 9/1979 | Japan | 431/330 |
| 0065843 | 12/1988 | Japan | 431/326 |
| 142203 | 9/1953 | Sweden | 431/326 |

OTHER PUBLICATIONS

Drawing of Babington Burner (No Date, No Text, No Name).

*Primary Examiner*—Carl D. Price
*Attorney, Agent, or Firm*—John R. Ross

[57] ABSTRACT

An aspirated wick atomizer nozzle device having a nozzle body and a screen wire wick sandwiched between the an outlet surface of the nozzle body and the inside surface of a nozzle cap. A liquid entering the nozzle body through a fuel inlet passes by a wicking action of the screen wire wick to a fuel and air exit port where it is entrained and atomized by a gas exiting the nozzle body through an air outlet orifice.

6 Claims, 2 Drawing Sheets

PRIOR ART

ASPIRATED WICK ATOMIZER NOZZLE

BACKGROUND OF THE INVENTION

It is known that highly efficient combustion of liquid fuel can be realized by providing very fine fuel droplet sizes. The rate at which fuel will burn is a function of its surface to volume ratio which is proportional to the quantity 1/r, where r is the radius of the fuel droplet. Small fuel particle sizes can be obtained using high pressure nozzles which force the fuel through very narrow passages or small orifices. Such devices work quite well at reasonably high fuel flow rates; however, the passages required for low fuel flow rates become so small that they clog easily if there are any solid contaminants in the fuel. These high pressure atomizers may also require the expenditure of substantial power by the fuel pump or the air blower.

Babbington Engineering, Inc. markets a low pressure atomizer. A sketch of this atomizer is shown in FIG. 1. Fuel is introduced at the topmost part of a hollow sphere. The liquid spreads out over the surface as the liquid flows downward forming a film of decreasing thickness as it approaches the equator of the sphere. Air under pressure is introduced into the inside of the sphere through a tube and leaves through a slot located on the equator where the film is a minimum. A portion of the fuel is blown away by the air stream and forms into very small droplets. The remainder of the liquid continues to flow downward and is collected at the bottom and is returned to the system. The Babbington atomizer is sensitive to orientation. The amount of fuel atomized is controlled by changing the air supply pressure which is a limitation on the extent of control. The device requires recirculation which means additional equipment.

What is needed is a better atomizer for use at low flow rates.

SUMMARY OF THE INVENTION

The present invention provides an aspirated wick atomizer nozzle device having a nozzle body and a screen wire wick sandwiched between the an outlet surface of the nozzle body and the inside surface of a nozzle cap. A liquid entering the nozzle body through a fuel inlet passes by a wicking action of the screen wire wick to a fuel and air exit port where it is entrained and atomized by a gas exiting the nozzle body through an air outlet orifice.

DETAILED DESCRIPTION OF PREFERRED EMBODIMENTS

Description

Figure 1:
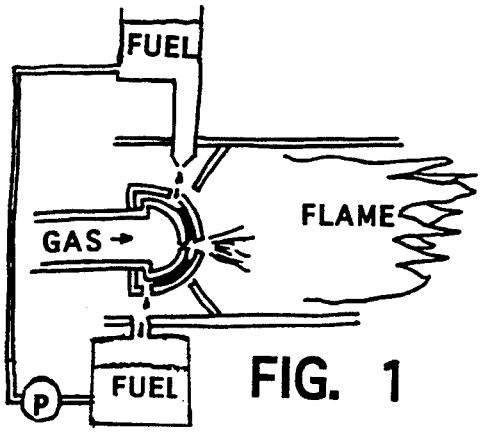
FIG. 1 shows a prior art atomizer.
Figure 2:
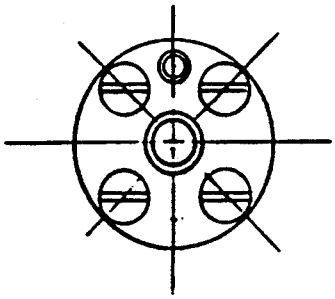
FIGS. 2 and 3 are views of preferred embodiment of the present invention.
Figure 3:
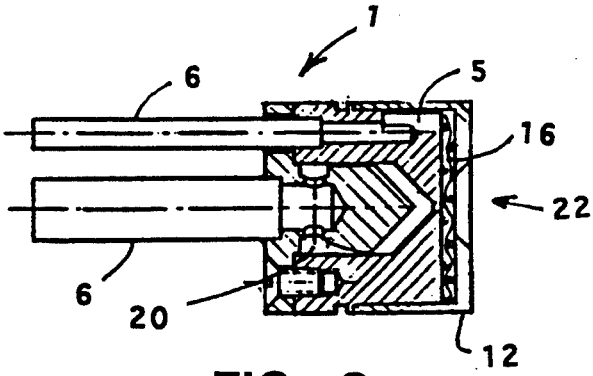
Figure 4:
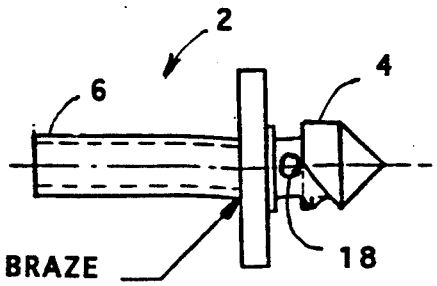
FIGS. 4 is a drawing of an inner body piece.
Figure 5:
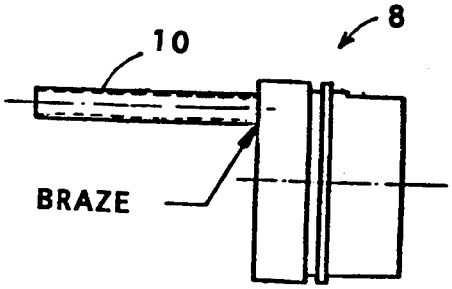
FIG. 5 another part called the outer body piece.
Figure 6:
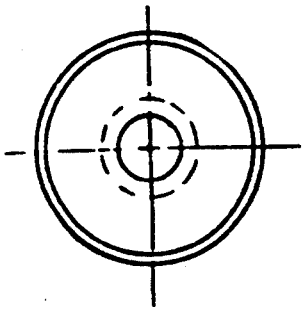
FIGS. 6 and 7 are two views of a cap.
Figure 7:
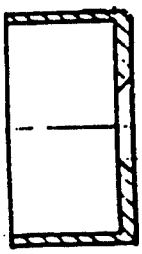
Figure 8:
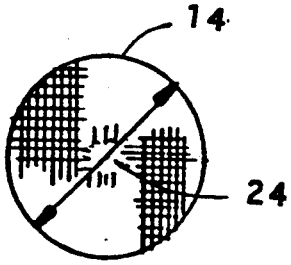
FIG. 8 is a drawing of a metal wire wick.

Preferred embodiments of the present invention can be described by reference to the figures. FIGS. 2 through 8 are a set of drawings describing a preferred embodiment of the present invention. The principal parts of the nozzle are shown in FIGS. 4 through 8 and the assembled nozzle is shown in FIG. 2 (back view) and FIG. 3 (side view). All parts are cut or machined from stainless steel. Inner body piece 2 is formed from a machined head 4 with a $\frac{3}{8}$ inch diameter steel air inlet tube 6 brazed to the head as shown in FIG. 4. Outer body piece 8 is machined form stainless steel and a $\frac{1}{8}$ inch diameter steel fuel inlet tube 10 is braised to it. Inner body piece 2 is connected to outer body piece 8 with four screws as shown in FIGS. 2 and 3. Together they form the nozzle body. Cap 12 is shown in FIGS. 6 and 7. Circular screen wick 14 with a $\frac{1}{8}$-inch hole in the center is comprised of stainless mesh steel screen wire. Its diameter is very slightly smaller than the inside diameter of cap 12.

Circular screen wick is fitted into cap 12 and cap 12 is fitted onto the nozzle body as shown in FIG. 3 and braised in place. Fuel such as DF 2 or JP8 enters the nozzle through fuel tube 10 at a pressure of about 0.5 psi at the top of the nozzle. It passes into chamber 5 and from there flows slowly over the face of the nozzle in the space shown at 16 partially filled by circular steel screen wick 14 causing a thin film to form across the screen. Air at about 5 psi enters air inlet tube 6, makes a 90 degree turn at the end of the tube and passes through hole 18 and the is forced into a swirling path through passage 20 and out of body 4 through a 1/32 inch diameter orifice 22. The air then expands through $\frac{1}{8}$-inch diameter hole 24 in steel screen wick 14 and on through 3/16 to $\frac{1}{4}$ inch hole in cap 12. The expanding air entrains and atomizes the fuel in the film.

Prototype Furnace

Figure 9:
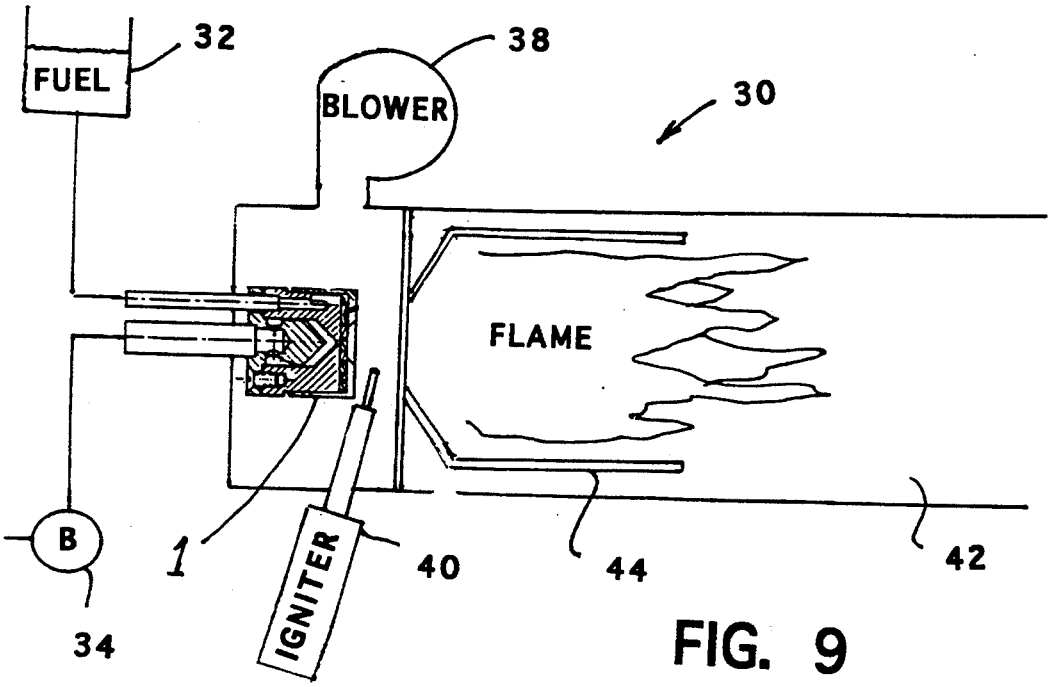
FIG. 9 is a drawing of a furnace using the present invention.

A part cross section, part schematic, part block drawing of a prototype furnace utilizing the present invention is shown in FIG. 9. Aspirated wick atomizer nozzle 1 is installed in furnace 30. Fuel, in this case DF2 fuel, is introduces into nozzle 1 from fuel tank 32 providing a pressure head of about 12 inches. Compressed air is provided by blower 34 which is a GAST rotary vane 14 liters per minute air pump. Atomized fuel is mixed with combustion air which is blown into furnace 30 by blower 38 providing a flow of about 100 cubic feet per minute. The air and fuel are ignited by igniter 40. The burning mixture exits furnace 30 through combustion tube 42. A portion of the air produced by blower 38 is directed around the sides of flame holder 44 in a swirling manner to stabalize the combustion and keep the sides of the furnace relatively cooler. The fuel flow rate is about 1 gallon per hour. The atomizer air flow rate is about 14 liters per minute. The total heat generated by the unit is about 130,000 BTU/hr. Because the fuel is atomized so well, the inventor estimates that the combustion efficiency is about 98 percent.

Test Results

The nozzle was tested with DF2 fuel at a pressure of about 12 inches of fuel column height. At an air pressure of 1.5 psi performance of the nozzle was not satisfactory. Several large droplets were observed and the spray was not uniform. Some of the fuel did drip out of the end of the nozzle. At about 2 psi air pressure all problems ceased. The atomized stream diverges with a half angled of about 15 degrees and the length of the plume is a function of air pressure. The fuel rate can be varied over a reasonably wide range with the degree of atomization increasing as the fuel rate decreases when the air return is constant. No fuel dripped from the nozzle during these variations. This means that the surface tension of the fuel in the screen wick is pulling the fuel to the air orifice as the film is atomized by the air and the excess does not accumulate at the bottom of the screen. During our experiment, we ignited the atomized fuel by placing a propane torch under the atomized stream. No visual evidence of burning was seen at first, except some light blue smoke which appeared several feet from the atomizer. However, the fuel was burning because we could feel the heat in the atomized stream. There was no evidence of orange flame, indicating that the atomized stream was burning cleanly and without excess carbon being present.

Uses of the Invention

The present invention has many uses. These uses include use as fuel nozzles in low heat rate external combustion burners such as are used in space heaters, thermoelectric generators and cooking stoves. They can also be used for throttle body fuel injection systems in internal combustion engines. Other uses are for a water atomizer in an air humidification system, in coal or grain elevator dust control system and an evaporative cooling system. It could be used as a liquid etchant atomizer in circuit board etching system, a liquid metal atomization in rapid solidification of metal powers and atomization of chemicals in a sol gel process.

Fuels and Oxidizers

Many fuels and oxidizers other than air can be used with the present invention. The fuel should not have an excessively high viscosity (i.e., viscosity should be less than about 0.5 lb-sec/ft$^2$). Fuels such as gasoline, DF2 (Diesel), DFA (arctic Diesel), Kerosene, JP4, JP5, JP8 and fuel oil are good. In some cases pure oxygen might preferably be substituted for air.

Uses Other Than Combustion

Use for the nozzle in application other than combustion include rapid solidification of metal, In this case Argon gas could be substituted for air. Informing sol-gels there are several gasses which would be preferable to air.

Screen Materials

Screen materials should be picked based on the application. In certain low temperature uses plastic screens could be used. In some applications brass, bronze or aluminum would be appropriate. In very high temperature applications persons should consider tungsten or molybdium or possibly a ceramic material such as ZrB2 or SiC. The thickness of the screen determines the distance between the nozzle body outlet surface and the inside surface of the nozzle cap. In our preferred embodiment that distance is about 1/16 inch. That distance could be increased but preferably it would be less than $\frac{1}{4}$ inch.

Operating Conditions

The fuel pressure should be high enough to introduce the desired amount of liquid to the wick. The air pressure limit is about 2 to 3 psi with DF2 fuel or with water. There is no upper limit on the air pressure except a pressure above that which causes a sonic velocity in the throat of the orifice (approximately 20 psi) is not recommended. The nozzle body outlet surface need not be flat. Many other shapes would provide obvious advantages in specific applications such as to increase or decrease the liquid flow rate. The recommended wick configurations is a simple square weave but other weaves could be used. Two levels of screen seems to help in some case. Course weaves have a lower tendency to clog, but better wicking action can in some cases be obtained with a finer weave. Finer weaves may be required if the nozzle is to be operated in an inverted position.

While the above description contains many specificities, the reader should not construe these as limitations on the scope of the invention, but merely as exemplifications of preferred embodiments thereof. Those skilled in the art will envision many other possible variations are within its scope. Accordingly the reader is requested to determine the scope of the invention by the appended claims and their legal equivalents and not by the examples which have been given.

I claim:

1. An aspirated wick atomizer nozzle comprising:

a) a nozzle body defining an outlet surface and comprising:
a liquid inlet,
a gas inlet and
a gas outlet orifice opening onto said outlet surface, b) a nozzle cap defining a liquid and gas exit port and an inside surface, said inside surface being approximately parallel to said nozzle body outlet surface and spaced apart from said nozzle body outlet surface by a spaced apart distance of less than $\frac{1}{4}$ inch, c) a screen wire wick confined between said outlet surface and said inside surface, said screen wire wick defining a mesh dimension and having a thickness substantially equal to said spaced apart distance and having a hole, defining a screen hole, aligned with said exit port said hole being substantially larger than said mesh dimension, wherein a liquid entering said liquid inlet will pass slowly by a wicking action to said screen hole and there be entrained in and atomized by gas entering said gas inlet and exiting said nozzle through said exit port.

2. A nozzle as in claim 1 wherein said screen wire wick is s stainless steel screen having a thickness of about 1/16 inch and said nozzle body outlet surface and said cap inside surface is spaced apart a distance of about 1/16 inch.

3. A nozzle as in claim 1 wherein said nozzle is configured to function to atomize a liquid fuel in a burner.

4. A nozzle as in claim 1 and further comprising a compressed air supply means for supplying compressed air at a pressure of at least 2 psi.

5. A nozzle as in claim 1 and further comprising an oxygen supply means for supplying oxygen at a pressure of at least 2 psi.

6. A nozzle as in claim 1 and further comprising a gas swirl means for forcing gas exiting said nozzle body gas outlet orifice into a swirling path.

* * * * *